US007261681B2

(12) United States Patent
Pehmöller et al.

(10) Patent No.: US 7,261,681 B2
(45) Date of Patent: Aug. 28, 2007

(54) METHOD AND APPARATUS FOR APPLYING ADDITIVE TO A MOVING, SPREAD-OUT FILTER MATERIAL WEB

(75) Inventors: Jürgen Pehmöller, Lauenburg (DE); Stephan Wolff, Glinde (DE); Irene Maurer, Hamburg (DE)

(73) Assignee: Hauni Maschinenbau Aktiengesellschaft, Hamburg (DE)

( * ) Notice: Subject to any disclaimer, the term of this patent is extended or adjusted under 35 U.S.C. 154(b) by 444 days.

(21) Appl. No.: 10/641,159

(22) Filed: Aug. 15, 2003

(65) Prior Publication Data

US 2004/0038790 A1 Feb. 26, 2004

(30) Foreign Application Priority Data

Aug. 16, 2002 (EP) ..... 02018460

(51) Int. Cl.
*B31C 13/00* (2006.01)

(52) U.S. Cl. ..... 493/49; 493/39; 493/44; 118/325; 131/37; 156/441

(58) Field of Classification Search ..... 493/39, 493/44, 49; 131/37; 156/441; 118/65, 325
See application file for complete search history.

(56) References Cited

U.S. PATENT DOCUMENTS 3,048,146 A * 8/1962 Coppola ..... 118/301
3,088,859 A * 5/1963 Smith ..... 264/518
4,005,806 A * 2/1977 Baldwin ..... 406/125
4,132,189 A 1/1979 Greve et al.
4,357,188 A * 11/1982 Mochida et al. ..... 156/180
4,511,420 A 4/1985 Arthur
4,525,385 A * 6/1985 Pryor ..... 427/177
4,776,351 A * 10/1988 Wahle et al. ..... 131/69
5,060,351 A * 10/1991 Street ..... 28/283
5,060,664 A 10/1991 Siems et al.
5,112,369 A * 5/1992 Brownell ..... 95/285
5,460,590 A * 10/1995 Greiner et al. ..... 493/4
5,630,432 A * 5/1997 Gaudlitz et al. ..... 131/284
5,964,146 A * 10/1999 Kelly et al. ..... 99/467
6,045,616 A * 4/2000 Williamson et al. ..... 118/301
6,167,935 B1 * 1/2001 Heider et al. ..... 156/567
6,235,345 B1 * 5/2001 Williamson et al. ..... 427/282
6,758,923 B2 * 7/2004 Butterworth et al. ..... 156/64

FOREIGN PATENT DOCUMENTS

DE 28 52 948 A1 6/1979
DE 42 09 606 A1 9/1993
DE 199 59 034 A1 6/2001

* cited by examiner

*Primary Examiner*—Christopher Harmon
(74) *Attorney, Agent, or Firm*—Venable LLP; Robert Kinberg; Catherine M. Voorhees

(57) ABSTRACT

A method and apparatus for supplying an additive to a moving web of filter material of the tobacco-processing industry are provided. An adjustable window defines an opening, and additive is applied through the window opening onto the web.

18 Claims, 4 Drawing Sheets

METHOD AND APPARATUS FOR APPLYING ADDITIVE TO A MOVING, SPREAD-OUT FILTER MATERIAL WEB

CROSS-REFERENCE TO RELATED APPLICATION

This application claims the priority of European Patent Application No. 02 018 460.2, filed on Aug. 16, 2002, the disclosure of which, together with the disclosure of each U.S. and foreign patent and patent application mentioned below, is incorporated herein by reference.

BACKGROUND OF THE INVENTION

The invention relates to a method and an apparatus for applying an additive, preferably a liquid additive, to a moving, spread-out filter material web used in the tobacco-processing industry with at least one spreading element. The invention further relates to an apparatus for producing filter rods for rod-shaped articles of the tobacco-processing industry.

During the production of filter rods used in the tobacco-processing industry, filter tow generally comprising cellulose acetate is pulled from a supply as a running web and is treated. Generally, the filter tow includes a woven material of loosely adhering threads which are pulled apart in order to form a wide and mostly level web such that the threads are moved side-by-side and essentially parallel to each other. The web is spread out inside a spreading nozzle. Following the spreading operation, an additive is supplied to the web. The additive is typically liquid and includes, for example, distributed triacetin drops. The drops dissolve the threads such that these threads permanently stick together, i.e., the threads are interlaced. The threads are then gathered to form a round rope and encased with a filter paper strip in a filter-rope machine. An additive embodied as a finely dispersed powdery substance can also be used in place of a liquid additive. Processing equipment of the type as described in the above is disclosed in U.S. Pat. Nos. 5,060,664 and 4,511,420.

The spraying of plasticizer onto filter tow with the aid of a row of nozzles, arranged transverse to the movement direction of the filter tow, is disclosed in German patent document DE-A-199 59 034. In this process, individual nozzles are controlled with sensors that record the density of the filter tow in the respective sections.

It is vitally important for the quality of the processing that the individual threads or fibers are well separated and that the plasticizer particles are applied evenly.

BRIEF SUMMARY OF THE INVENTION

It is an object of the present invention to provide the filter material with an even coating of the additive such that it is possible to easily adapt the amount of additive applied to the filter material and such that the use of the additive can be minimized and the amount of additive that is applied can be precisely metered.

According to the invention, this and other objects are achieved by adjusting the size of a window opening and applying the additive through the window opening to the web of filter material as the web of filter material moves past. The size can be adjusted as necessary to supply the optimum amount of additive to the web. The invention incorporates the concept that the amount of additive to be supplied is matched to the filter material and/or to the filter to be produced. The term "application area" is understood to refer in particular to the area through which additive is spread to be applied onto the filter material conveyed past. Generally, the area is defined as an opening in an adjustable window. The present invention provides that the size of this application area is predetermined and can be varied.

Due to the variability of the application area, it is possible to meter out the amount of applied additive. The adjustable application area also provides that the amount of additive used is reduced because the amount of excess additive that is not absorbed by the filter material is reduced.

According to an exemplary embodiment of the invention, the application area is changed by adjusting at least one covering element. The covering element is part of the window that defines the opening that constitutes the application area. The application area can be adapted easily and quickly, for example by displacing the covering element, to the desired spreading amount and/or the width of the filter material strip. For example, a dry filter material can be produced by completely covering or partitioning the application area. In this case, the application area would be zero. Dry filters are understood to be filters without additives. In this case, the additive can be supplied continuously, but the additive is not spread onto the filter material because the material is completely covered.

The additive is spread evenly onto the filter material by maintaining the amount of additive supplied to the filter material at a constant rate and/or pressure. Because of the adjustable application area, the amount of additive to be supplied to the nozzles or other spreading element can be kept constant, regardless of the filter material.

According to another exemplary additional embodiment of the invention, the additive not absorbed by the filter material is drained off, collected, removed and/or reused.

The adherence between filter material and additive can be increased by administering a charge to the filter material and/or the additive. A voltage source can be provided for this purpose.

The additive can be applied evenly onto the filter material by spraying the additive with at least one nozzle through the application area onto at least one side of the filter material web. In an exemplary embodiment, several nozzles are provided on one side and, generally, the nozzles are arranged in several rows.

The even application of the additive onto the filter material is enhanced if at least one nozzle is supplied with additive at a constant pressure. An optimum droplet size and speed for the additive is achieved with a uniform system pressure. If several spray nozzles are used, the spray formations can overlap in the form of spray cones or spray triangles.

In a further exemplary embodiment, triacetin is applied as the additive to the filter material. Triacetin has proven to be a suitable plasticizer and curing agent for the production of filter rods.

At least one escape barrier can be provided to reduce or prevent additive, i.e. plasticizer, from escaping the apparatus.

Excess amounts of additive that are not absorbed can be returned to the apparatus if a belt element is used as a removal mechanism.

The collection mechanism for additive that is not absorbed is preferably designed as a stripping edge and/or as a collecting basin.

According to another aspect of the invention, there is provided an apparatus that includes an adjustable window that defines an opening, and at least one spreading element for applying additive through the opening in the window onto the web of fiber material as the material moves past.

In an exemplary embodiment, a housing is provided for the apparatus to enclose the spreading element, the adjustable window that defines the application area, and any other apparatus components.

The present invention can also be incorporated to an arrangement for producing filter rods for rod-shaped articles in the tobacco processing industry.

Thus, in accordance with the present invention, additive, for example triacetin, is applied, for example by spraying, evenly onto the filter tow. The amount of additive applied is adjusted via an adjustable application area. Excess amount of additive not absorbed by the filter material can be removed. The non-absorbed additive can be taken up by a circulating belt and stripped off with the aid of a stripping edge. The spreading of the additive can be aided by administering charges with opposite polarity to the filter tow and/or the additive.

BRIEF DESCRIPTION OF THE DRAWINGS

The invention is described in the following with the aid of exemplary embodiments and without restricting the general inventive idea by referring to the drawings, to which reference is made for all details of the invention not explicitly explained in the text.

DETAILED DESCRIPTION OF THE INVENTION

In the Figures described herein, the same elements are given the same reference numbers and will not be introduced anew in each case.

Figure 1:
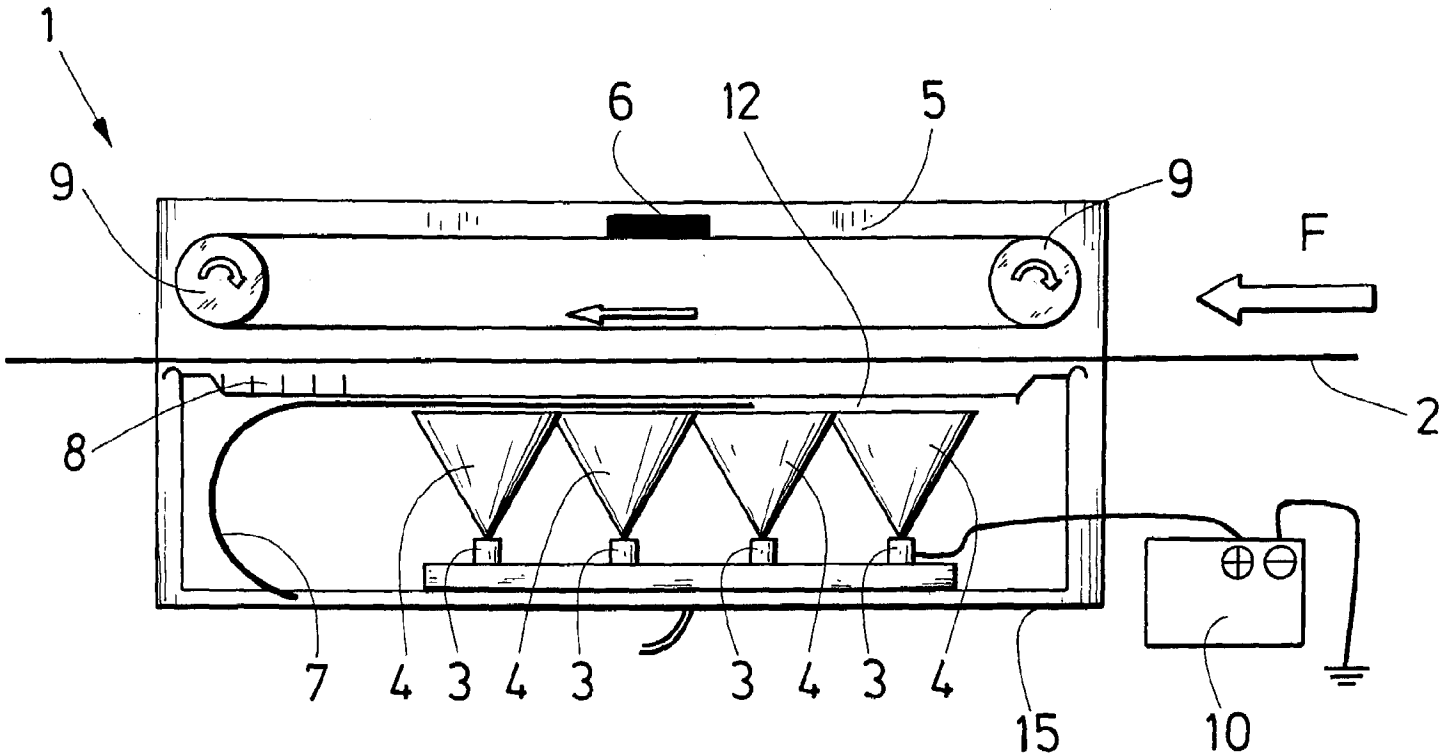
FIG. 1 shows a cross-sectional view of an apparatus according to the invention.

FIG. 1 shows an apparatus 1 for applying an additive, for example a plasticizer such as triacetin, onto a spread-out filter tow 2 or onto a filter material strip. As shown in FIG. 1, the filter tow 2 is conveyed from the right side to the left side in accordance with the conveying direction F.

Spray nozzles 3 are arranged in the lower region of apparatus 1 at a predetermined distance to each other. The spray nozzles 3 respectively produce one spray cone 4. In the exemplary embodiment, the spray nozzles are arranged equidistant to each other and in the same plane to produce a constant and even spraying pattern. A finely dispersed, fog-type hollow cone of atomized softener is obtained with these spray nozzles 3. Axial hollow cone nozzles that may be used to implement the invention are produced by Lechler GmbH & Co. KG. of Metzingen, Germany.

The spray nozzles 3 are supplied with a uniform system pressure by one or several supply sources to ensure an optimum droplet size and droplet speed. The spray cones 4 can overlap for an optimum spray pattern. The spray nozzles 3 are arranged below the filter tow 2 and additive is sprayed from below the filter tow 2 that is conveyed past. A displaceable, and in particular motor-driven, covering sheet 7 is arranged between the spray nozzles 3 and the filter tow 2 such that the spray from the spray cones 4 is delimited and the additive is spread via an application area 12. The size of the application area 12 can be varied. For example, the application area 12 can be zero for the dry filter removal. In this case, no fog 4 at all will be sprayed onto the filter tow 2. The size of the application area 12 can be increased or reduced, depending on the application, the filter tow type and/or the filter tow amount. In an exemplary embodiment, during all applications, the spray nozzles 3 continue to be supplied with additive at a constant pressure. On the whole, the present invention produces a constant spraying pattern.

A voltage source 10, in particular a high-voltage source, can be provided to administer a charge to the particles of additive (see FIG. 1) or the filter tow 2 (see FIG. 2*a*) in order to achieve a better adherence of the additive particles of the atomized fog 4 to the filter tow 2. Applying electrical charges to the filter tow is disclosed, for example, in German patent document DE-A-42 09 606.

The displaceable covering sheet 7 is used to control the amount of additive applied to the filter tow 2 by increasing or decreasing the size of the application area 12 to delimit the spray cones 4, depending on the requirements of the application. The covering sheet 7 can be, for example, a flexible metal sheet and can be moved with the aid of a motor and/or a spindle.

A circulating belt 5 that circulates via rollers 9 can be installed above the filter tow 2 and extends over the complete length of the apparatus 1. With the surface of the belt 5 facing the filter tow 2, the belt 5 picks up the additive not absorbed by the filter tow 2. Following a deflection, the belt 5 is guided along a stripping edge 6 such that excess additive can be removed from the belt 5. The belt 5 speed is typically below the limit where the additive would fall off the belt during the deflection. The belt speed is therefore considerably below the filter tow speed. Parallel arranged spray fog barriers 8 are provided at the discharge end of the apparatus 1 to prevent or reduce the amount of additive that would otherwise escape from the apparatus 1. The apparatus 1 can be provided with a housing 15 to enclose some or all of the components of the apparatus.

The additive picked up by the belt 5 is stripped off with the aid of the stripping edge 6 arranged transverse to the belt 5. In the process, the additive liquid is again deposited in the lower region of the apparatus 1. The additive is collected in a basin or vat 13 (not shown in FIG. 1, see for example FIG. 3*a*), which can be installed with a tilt to aid in collection and removal. The excess material is removed via a return flow 11 and flows back into the supply container (not shown) for the spray nozzles 3.

Figure 2A:
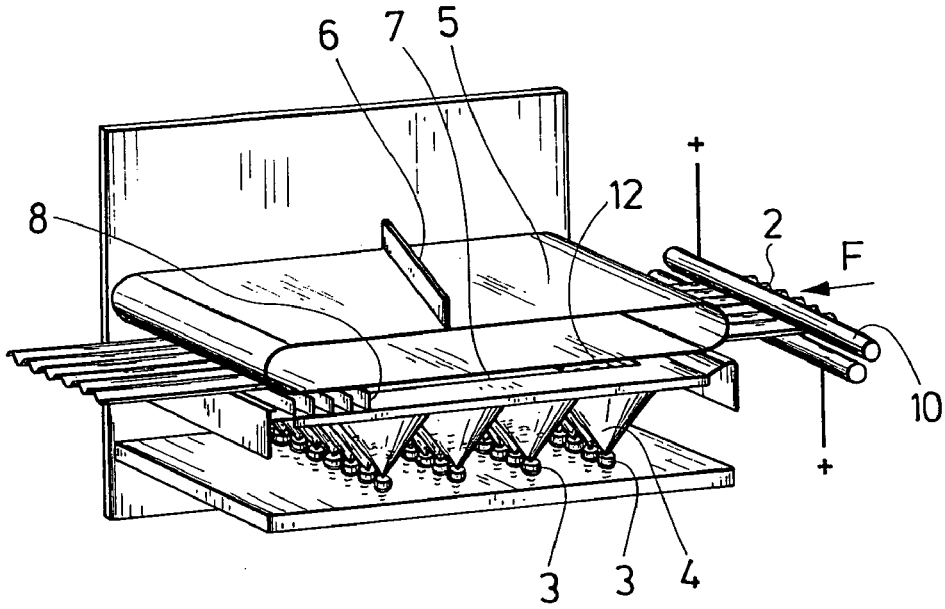
FIGS. 2*a* and 2*b* show perspective sectional views of the apparatus.
Figure 2B:
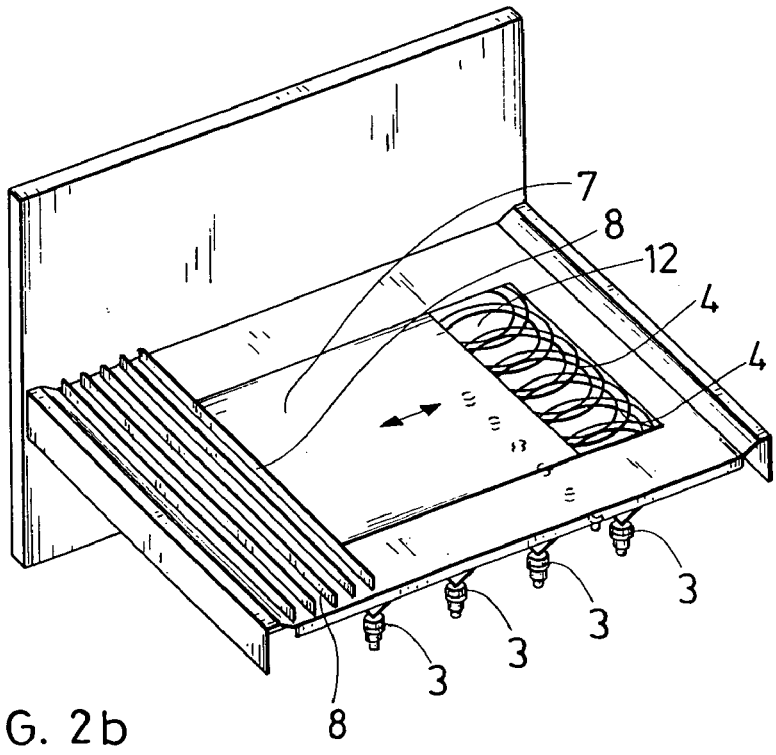

FIGS. 2*a* and 2*b* show schematic, perspective views of the apparatus 1 in which certain parts are omitted for a better understanding and illustration. The spray nozzles 3 are regularly spaced below the filter tow 2 and create a two-dimensional application area 12. As a result of the constant feed pressure, the additive is applied uniformly to the filter tow 2 with the aid of the spray nozzles 3. The stripping edge 6 above the belt 5 is arranged transverse to the movement direction of the belt 5 such that the excess additive picked up by the belt 5 is guided toward at least one side of the belt, and then runs down into a collection basin or vat (not shown in FIGS. 2*a* and 2*b*). As indicated in FIG. 2*b*, the covering sheet 7 can be displaced such that the spreading surface 12 can be increased or reduced.

Figure 3A:
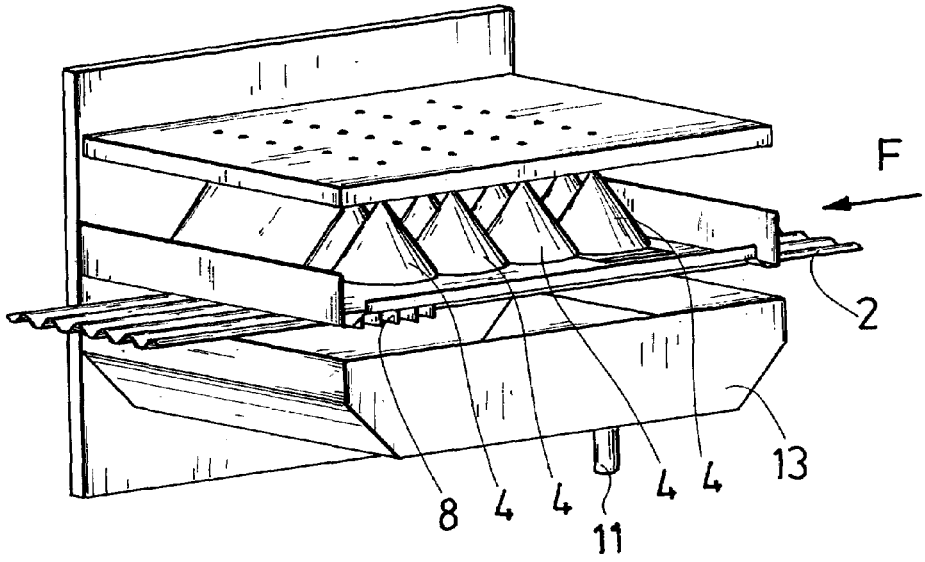
FIGS. 3*a* and 3*b* show a perspective view and a side view of an alternate embodiment.
Figure 3B:
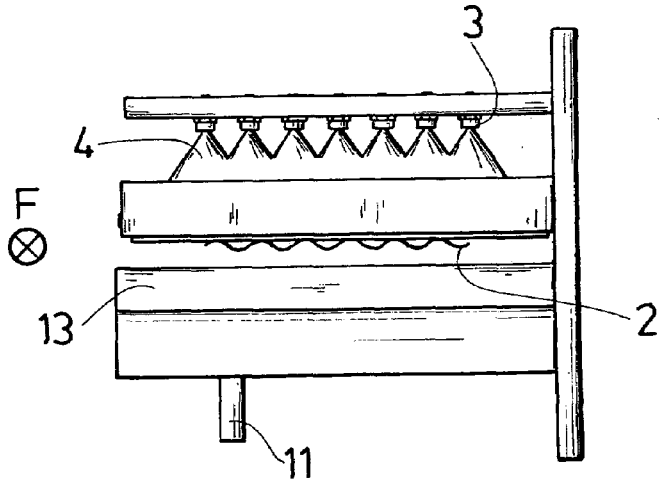

FIGS. 3*a* and 3*b* show an alternate embodiment in which the additive is applied from above onto the filter tow 2. The additive not absorbed by the filter tow 2 is removed to the sides with the aid of the covering sheet and is guided into the lower catch basin 13. The excess additive can be once more supplied via the return line 11 to the feed tank.

Figure 4A:
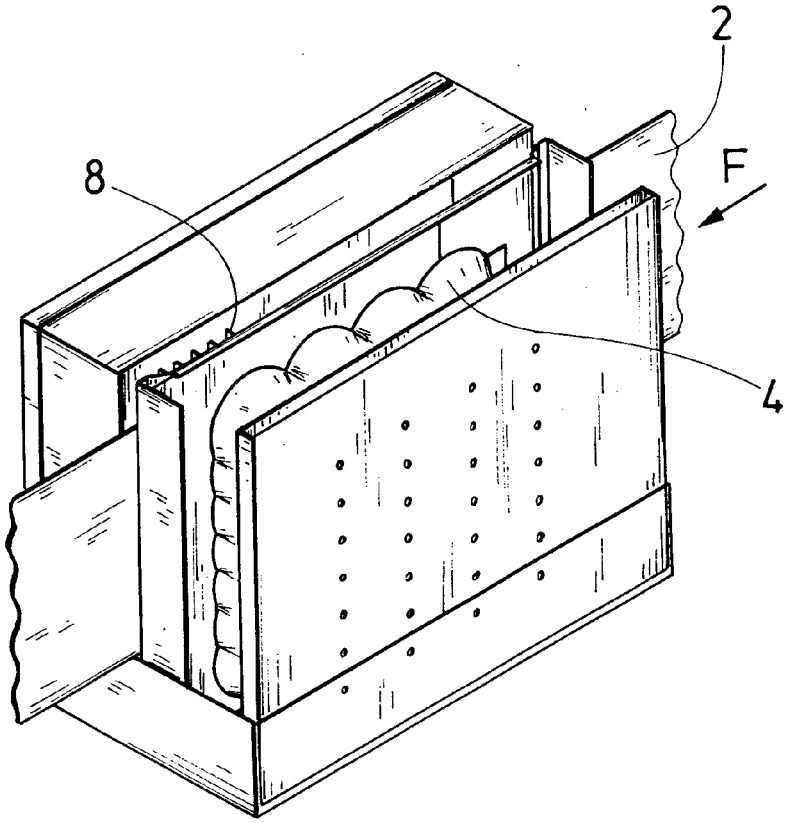
FIGS. 4*a* and 4*b* show a perspective view and a side view of a further embodiment.
Figure 4B:
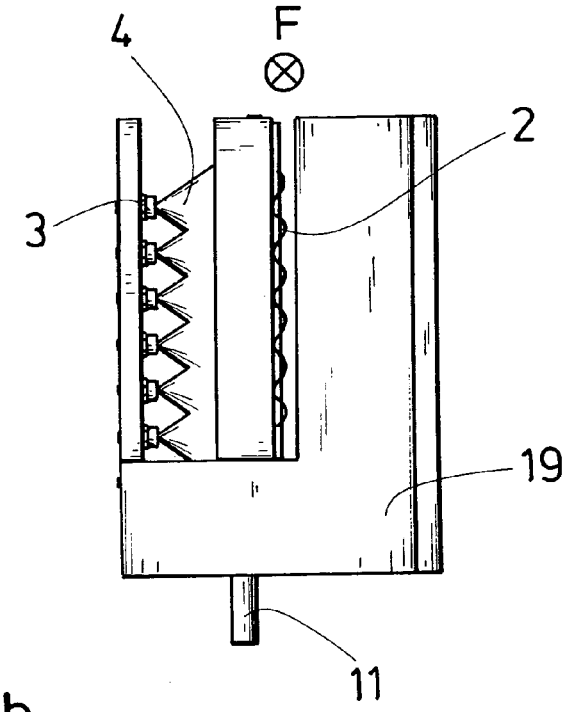

FIGS. 4*a* and 4*b* show a further alternate embodiment in which additive is supplied from the side of a vertically arranged filter tow 2.

The invention has been described in detail with respect to exemplary embodiments, and it will now be apparent from the foregoing to those skilled in the art, that changes and modifications may be made without departing from the invention, therefore, as defined in the appended claims, is intended to cover all such changes and modifications that will fall within the true spirit of the invention.

The invention claimed is:

1. A method of applying an additive to a moving, spread-out filter material web used in the tobacco-processing industry, comprising:

adjusting a window that includes at least one adjustable covering element that at least partially defines an opening of the window wherein the adjusting step includes moving the at least one adjustable covering element across the window; and applying the additive through the opening of the window onto the spread-out web of filter material as the web of filter material moves past wherein the amount of additive applied to the filter material is adjusted via the movement of the adjustable covering element.

2. The method according to claim 1, further comprising adjusting the at least one adjustable covering element to provide an optimum amount of additive to the moving, spread-out web.

3. The method according to claim 1, wherein the applying step includes spreading additive from a spreading element at a constant rate and independent from the adjusting step.

4. The method according to claim 1, further comprising removing and collecting additive not absorbed by the web filter material.

5. The method according to claim 1 further comprising administering a charge to at least one of the filter material and the additive.

6. The method according to claim 1, wherein the applying step includes spraying additive with at least one nozzle through the opening of the window onto at least one side of the web of the filter material web.

7. The method according to claim 6, wherein the spraying step includes supplying the additive to the at least one nozzle at a constant pressure.

8. The method according to claim 1, wherein the applying step includes applying triacetin as the additive.

9. An apparatus for applying an additive to a moving, spread-out filter material web used in the tobacco-processing industry, comprising:

a window including at least one adjustable covering element that at least partially defines an opening of the window wherein movement of the at least one adjustable covering element across the window adjusts the size of the opening; and at least one spreading element for applying additive through the opening in the window onto the spread-out web of fiber material as the web of fiber material moves past wherein the amount of additive applied to the filter material is adjusted via the movement of the adjustable covering element.

10. The apparatus according to claim 9, further comprising at least one of means for removing and means for collecting additive material not absorbed by the web of filter material.

11. The apparatus according to claim 9, further comprising at least one voltage source for administering a charge to at least one of the web of filter material and the additive.

12. The apparatus according to claim 9, wherein the at least one spreading element includes at least one nozzle facing at least one side of the web of filter material.

13. The apparatus according to claim 12, wherein the at least one nozzle is supplied with additive at a constant pressure.

14. The apparatus according to claim 10, wherein the removal means includes a belt element.

15. The apparatus according to claim 10, wherein the collecting means includes at least one of a stripping edge and a basin.

16. The apparatus according to claim 9, further comprising a housing for enclosing the at least one spreading element, the adjustable covering element and the window.

17. The apparatus according to claim 16, wherein the housing includes at least one exit barrier to prevent additive from exiting the apparatus.

18. An arrangement for producing filter rods for rod-shaped articles in the tobacco-processing industry, comprising the apparatus according to claim 9.

* * * * *